US007931452B2

(12) United States Patent
Hibino et al.

(10) Patent No.: US 7,931,452 B2
(45) Date of Patent: Apr. 26, 2011

(54) SUCTION THROTTLE VALVE OF A COMPRESSOR

(75) Inventors: Sokichi Hibino, Kariya (JP); Shiro Hayashi, Kariya (JP); Masaki Ota, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 783 days.

(21) Appl. No.: 11/983,488

(22) Filed: Nov. 8, 2007

(65) Prior Publication Data

US 2008/0131297 A1 Jun. 5, 2008

(30) Foreign Application Priority Data

Nov. 10, 2006 (JP) ..... 2006-305331

(51) Int. Cl.
*F04B 49/03* (2006.01)

(52) U.S. Cl. ..... 417/295; 417/269; 417/298; 417/309; 417/441; 137/493.9; 137/513.3

(58) Field of Classification Search ..... 417/222.2, 417/269, 270, 295, 298, 309, 441, 296; 92/12.2; 137/493.9, 513.3

See application file for complete search history.

(56) References Cited

U.S. PATENT DOCUMENTS

| | | | | | |
|---|---|---|---|---|---|
| 3,701,361 | A | * | 10/1972 | Bunn et al. | 137/543.23 |
| 4,691,526 | A | * | 9/1987 | Kobayashi et al. | 62/217 |
| 4,856,292 | A | * | 8/1989 | Kawai et al. | 62/217 |
| 4,867,649 | A | * | 9/1989 | Kawashima et al. | 417/222.2 |
| 4,905,477 | A | * | 3/1990 | Kazuhiko | 62/196.3 |
| 5,411,375 | A | * | 5/1995 | Bauer | 417/295 |
| 5,577,894 | A | * | 11/1996 | Kawaguchi et al. | 417/222.2 |
| 5,778,925 | A | * | 7/1998 | Cooke | 137/493.6 |
| 5,785,502 | A | * | 7/1998 | Ota et al. | 417/222.2 |
| 5,823,000 | A | * | 10/1998 | Takai | 62/133 |
| 5,988,988 | A | * | 11/1999 | Tokumasu | 417/222.2 |
| 6,099,263 | A | * | 8/2000 | Bodzak et al. | 417/295 |
| 6,149,397 | A | * | 11/2000 | Mizutani et al. | 417/222.2 |
| 6,189,562 | B1 | * | 2/2001 | Lorentz | 137/469 |
| 6,257,848 | B1 | | 7/2001 | Terauchi | 417/441 |
| 6,267,562 | B1 | * | 7/2001 | Hirota | 417/222.2 |
| 6,340,031 | B1 | * | 1/2002 | Matsumoto et al. | 137/513.3 |

(Continued)

FOREIGN PATENT DOCUMENTS

| | | |
|---|---|---|
| JP | 2000-136776 | 5/2000 |
| JP | 2001-289177 | 10/2001 |
| JP | 2005-337232 | 12/2005 |

*Primary Examiner* — Devon C Kramer
*Assistant Examiner* — Leonard J Weinstein
(74) *Attorney, Agent, or Firm* — Locke Lord Bissell & Liddell LLP

(57) ABSTRACT

A compressor has a suction throttle valve, which includes a suction passage, a suction port, a valve body, an urging member, a valve chamber, a first communication hole, a closing valve and a valve seat. The closing valve closes the hole of the valve body by pressure difference between the valve chamber and the suction port. The valve seat limits movement of the closing valve toward the suction port. The hole of the valve body is closed when the closing valve is in contact with the valve body, and open when the closing valve is in contact with the valve seat. A communication passage is formed in the closing valve or the valve seat, which enables communication between the hole of the valve body and the suction port when the closing valve is in contact with the valve seat.

11 Claims, 6 Drawing Sheets

U.S. PATENT DOCUMENTS 6,953,325 B2 * 10/2005 Weber et al. ..... 417/222.2
7,204,098 B2 * 4/2007 Yamada et al. ..... 62/470
7,399,169 B2 * 7/2008 Nakamura ..... 417/441
2004/0228738 A1 * 11/2004 Hashimoto et al. ..... 417/222.2
2004/0258536 A1 * 12/2004 Ota et al. ..... 417/222.2
2005/0008499 A1 * 1/2005 Umemura et al. ..... 417/222.2

* cited by examiner

SUCTION THROTTLE VALVE OF A COMPRESSOR

BACKGROUND OF THE INVENTION

The present invention relates to a suction throttle valve of a compressor for use, for example, in an automotive air conditioning system and, more particularly, to a suction throttle valve of a variable displacement compressor for reducing the vibration and noise that are due to pulsation of suction refrigerant gas.

There is generally known a variable displacement compressor for use in an automotive air conditioning system and the like, which is capable of variably controlling its displacement. Such variable displacement compressor will be referred to merely as a "compressor" hereinafter. The compressor often generates noise which is due to pulsation of suction refrigerant produced when the flow rate of suction refrigerant is low. As measures against the development of such noise, some compressors have used a suction throttle valve interposed between the suction port and the suction chamber for changing open area of its suction passage in accordance with the flow rate of suction refrigerant. Japanese Patent Application Publication No. 2000-136776 discloses a compressor having this type of suction throttle valve. In the compressor of the reference, a gas passage is formed between the suction port and the suction chamber, and a valve chamber is formed between the gas passage and the suction port. The compressor has an opening control valve whose valve body is vertically movably disposed in the valve chamber. The valve body is urged upward by a spring. The valve body of the opening control valve is moved vertically in the valve chamber thereby to control the opening of the gas passage in accordance with flow rate of refrigerant gas drawn into the suction chamber through the suction port. The valve chamber communicates with the suction chamber through a communication hole and the valve body has formed therethrough a hole.

In such a compressor, the suction port communicates with the suction chamber through the hole of the valve body, the valve chamber and the communication hole. Therefore, vacuuming of the air conditioning system including the compressor, which is performed before charging with refrigerant, can be accomplished by removing air through the suction port. Additionally the pressure in the suction chamber increases remarkably when the compressor is turned off during its operation, but the increased pressure in the suction chamber is released therefrom to the suction port through the communication hole, the valve chamber and the hole of the valve body, thus the pressure in the suction chamber being reduced.

In the compressor of the reference, however, when the flow rate of suction refrigerant is low during the operation of the compressor, part of the refrigerant flowing into the suction chamber through the suction port leaks into the valve chamber through the hole of the valve body through which the valve chamber and the suction port communicate with each other. The hole of the valve body reduces throttling effect of the valve body of the opening control valve, which causes noise due to the pulsation of suction refrigerant gas. Although the hole of the valve body may be formed with a reduced open area as measures against the development of such noise, it takes a long time to vacuum the compressor when the open area is too small. In releasing the increased pressure in the suction chamber to the suction port through the communication hole, the valve chamber and the hole of the valve body when the compressor is turned off during its operation, it takes a long time to exhaust the compressor of high-pressure fluid through the hole when the open area of the hole is too small. In the meantime, the pressure in the valve chamber increases remarkably, so that the valve body of the opening control valve is pushed against the housing of the compressor by a high load. Therefore, the housing should be made with a sufficient strength to resist the load.

The present invention, which has been made in light of the above problems, is directed to a suction throttle valve of a compressor which improves the reliability of the compressor by reducing the vibration and noise developed by pulsation of suction refrigerant during operation of the compressor, and also by securely exhausting the compressor of an internal fluid in vacuuming and also by securely releasing high-pressure fluid in a suction chamber of the compressor when the compressor is turn off during its operation.

SUMMARY OF THE INVENTION

In accordance with an aspect of a compressor according to the present invention, the compressor has a suction throttle valve and a compressor housing having formed therein a suction chamber. The suction throttle valve includes a suction passage, a suction port, a valve body, an urging member, a valve chamber, a first communication hole, a hole, a closing valve and a valve seat The suction passage is formed in the housing. The suction port is formed at an inlet of the suction passage, through which refrigerant is drawn into the suction passage and further into the suction chamber. The valve body is movably disposed in the suction passage for adjusting opening of the suction passage. The urging member urges the valve body toward the suction port. The valve chamber is provided in the suction passage and the urging member is disposed in the valve chamber. The first communication hole is formed through the housing, through which the valve chamber and the suction chamber are in communication with each other. The hole is formed through the valve body, through which the valve chamber and the suction port are in communication with each other. The closing valve closes the hole of the valve body by pressure difference between pressure in the valve chamber and pressure at the suction port. The valve seat is provided in the suction passage for limiting movement of the closing valve toward the suction port. The hole of the valve body is closed when the closing valve is in contact with the valve body. The hole of the valve body is open when the closing valve is in contact with the valve seat. A communication passage is formed in the closing valve or the valve seat, which enables communication between the hole of the valve body and the suction port when the closing valve is in contact with the valve seat.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims, The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
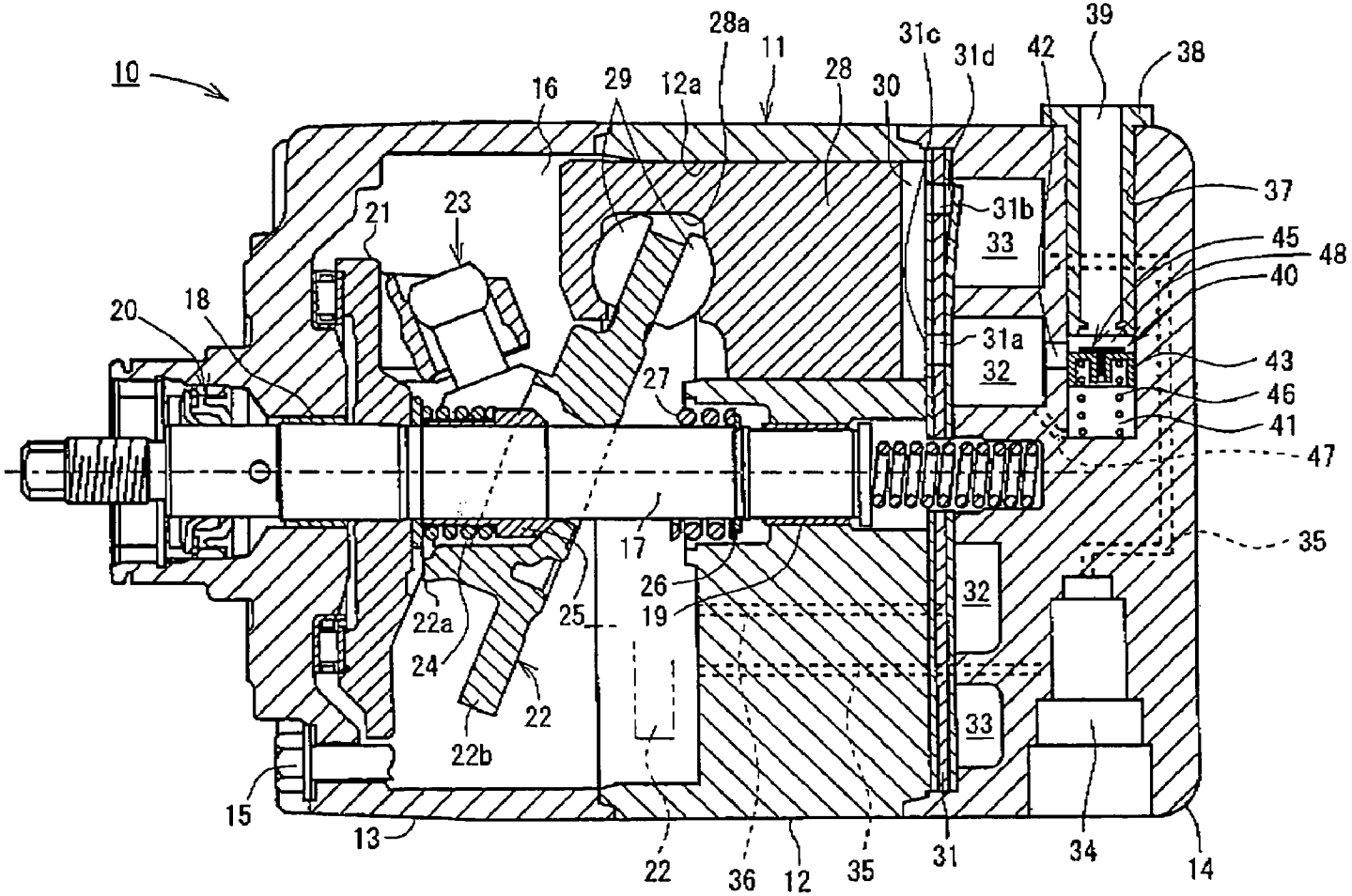
FIG. 1 is a longitudinal sectional view showing a compressor according to a first embodiment of the present invention.

The following will describe a suction throttle valve of a compressor according to the first embodiment of the present invention as applied to a variable displacement swash plate compressor (hereinafter referred to merely as "compressor") with reference to FIGS. 1 through 4C. Referring to FIG. 1, the compressor 10 has a housing 11 or a compressor housing as an outer shell of the compressor 10. The left-hand side and the right-hand side of the compressor 10 as viewed in FIG. 1 correspond to the front and rear of the compressor 10, respectively. The housing 11 includes a cylinder block 12, a front housing 13 joined to the front end of the cylinder block 12, and a rear housing 14 joined to the rear end of the cylinder block 12. The front housing 13, the cylinder block 12 and the rear housing 14 are fastened together by a plurality of bolts 15 (only one being shown in FIG. 1) inserted in bolt holes through the front housing 13, the cylinder block 12 and the rear housing 14.

The front housing 13 and the cylinder block 12 cooperate to define a crank chamber 16 through which a drive shaft 17 extends. The drive shaft 17 is rotatably supported by radial bearings 18 and 19 which are provided at the respective centers of the front housing 13 and the cylinder block 12. A shaft seal mechanism 20 is provided on the drive shaft 17 at a position forward of the radial bearing 18 in sliding contact with the outer circumferential surface of the drive shaft 17. The drive shaft 17 is connected at its front end to an external drive source (not shown) through a power transmission mechanism (not shown).

A lug plate 21 is fixed to the drive shaft 17 in the crank chamber 16 for rotation therewith. A swash plate 22 as a part of the displacement changing mechanism of the compressor is provided behind the lug plate 21 and supported by the drive shaft 17 so as to be slidable in the axial direction of the drive shaft 17 and also inclinable relative to the axis of the drive shaft 17. A hinge mechanism 23 is provided between the swash plate 22 and the lug plate 21, through which the swash plate 22 is connected to the lug plate 21 so that the swash plate 22 is synchronously rotatable with the lug plate 21 and inclinable relative to the drive shaft 17.

A coil spring 24 is disposed on the drive shaft 17 between the lug plate 21 and the swash plate 22. A sleeve 25 is slidably disposed on the drive shaft 17 and urged rearward by the coil spring 24. The sleeve 25 in turn urges the swash plate 22 rearward or in the direction which causes the inclination angle of the swash plate 22 to be decreased. It is noted that the inclination angle of the swash plate 22 refers to an angle made between an imaginary plane perpendicular to the axis of the drive shaft 17 and a flat surface of the swash plate 22.

The swash plate 22 has a stop 22*a* projecting from the front thereof for determining the maximum inclination angle of the swash plate 22 by contact with the lug plate 21 as shown in FIG. 1. A snap ring 26 is fitted on the drive shaft 17 behind the swash plate 22 and a coil spring 27 is disposed on the drive shaft 17 between the snap ring 26 and the swash plate 22. The minimum inclination angle of the swash plate 22 is determined by the contact of the swash plate 22 with the front of the coil spring 27 which is held at the rear thereof by the snap ring 26. In FIG. 1, the swash plate 22 indicated by the solid line is positioned at its maximum inclination angle and the swash plate 22, part of the outer peripheral portion of which is indicated by the chain double-dashed line, is positioned at its minimum inclination angle.

The cylinder block 12 has formed therethrough a plurality of cylinder bores 12*a* (only one being shown in FIG. 1) and a single headed-piston 28 is reciprocally slidably received in each cylinder bore 12*a*. Each piston 28 has formed at the neck thereof a recess 28*a* for receiving therein a pair of shoes 29. The outer periphery 22*b* of the swash plate 22 is held by and in sliding contact with each pair of shoes 29 of the piston 28, as shown in FIG. 1. As the drive shaft 17 is rotated, the swash plate 22 is rotated synchronously therewith while making a wobbling motion in the axial direction of the drive shaft 17, thereby causing the pistons 28 to reciprocate in their cylinder bores 12*a* through the shoes 29.

As shown in FIG. 1, the front end of the rear housing 14 is joined to the rear end of the cylinder block 12 through a valve plate assembly 31. A suction chamber 32 is formed in the rear housing 14 at a radially inner region and a discharge chamber 33 is formed in the rear housing 14 at a radially outer region thereof. The suction chamber 32 and the discharge chamber 33 communicate with a compression chamber 30 in each cylinder bore 12*a* through a suction hole 31*a* and a discharge hole 31*b* formed in the valve plate assembly 31, respectively. The suction hole 31*a* and the discharge hole 31*b* are provided with a suction valve 31*c* and a discharge valve 31*d*, respectively. As the piston 28 moves from its top dead center toward its bottom dead center in operation of the compressor, refrigerant gas in the suction chamber 32 is drawn into the compression chamber 30 through the suction hole 31*a* and the suction valve 31*c*. As the piston 28 moves from its bottom dead center toward its top dead center, on the other hand, the refrigerant gas which has been drawn in the compression chamber 30 is then compressed to a predetermined pressure and discharged into the discharge chamber 33 through the discharge hole 31*b* and the discharge valve 31*d*.

The compressor 10 has a displacement control valve 34 which is disposed in the rear housing 14 for changing the inclination angle of the swash plate 22 thereby to adjust the stroke of the pistons 28 and hence to control the displacement of the compressor 10. The displacement control valve 34 is arranged in a supply passage 35 which interconnects the crank chamber 16 and the discharge chamber 33 for fluid communication therebetween. A bleed passage 36 is formed in the cylinder block 12 for fluid communication between the crank chamber 16 and the suction chamber 32. The pressure in the crank chamber 16 depends on the relation between the amount of high-pressure refrigerant gas drawn from the discharge chamber 33 into the crank chamber 16 through the supply passage 35 and the amount of refrigerant gas flowing out from the crank chamber 16 into the suction chamber 32 through the bleed passage 36. The relation between these two pressures is adjusted by changing the opening of the displacement control valve 34. Thus, the pressure difference between the crank chamber 16 and the compression chamber 30 through the piston 28 is varied thereby to change the inclination angle of the swash plate 22.

Figure 2:
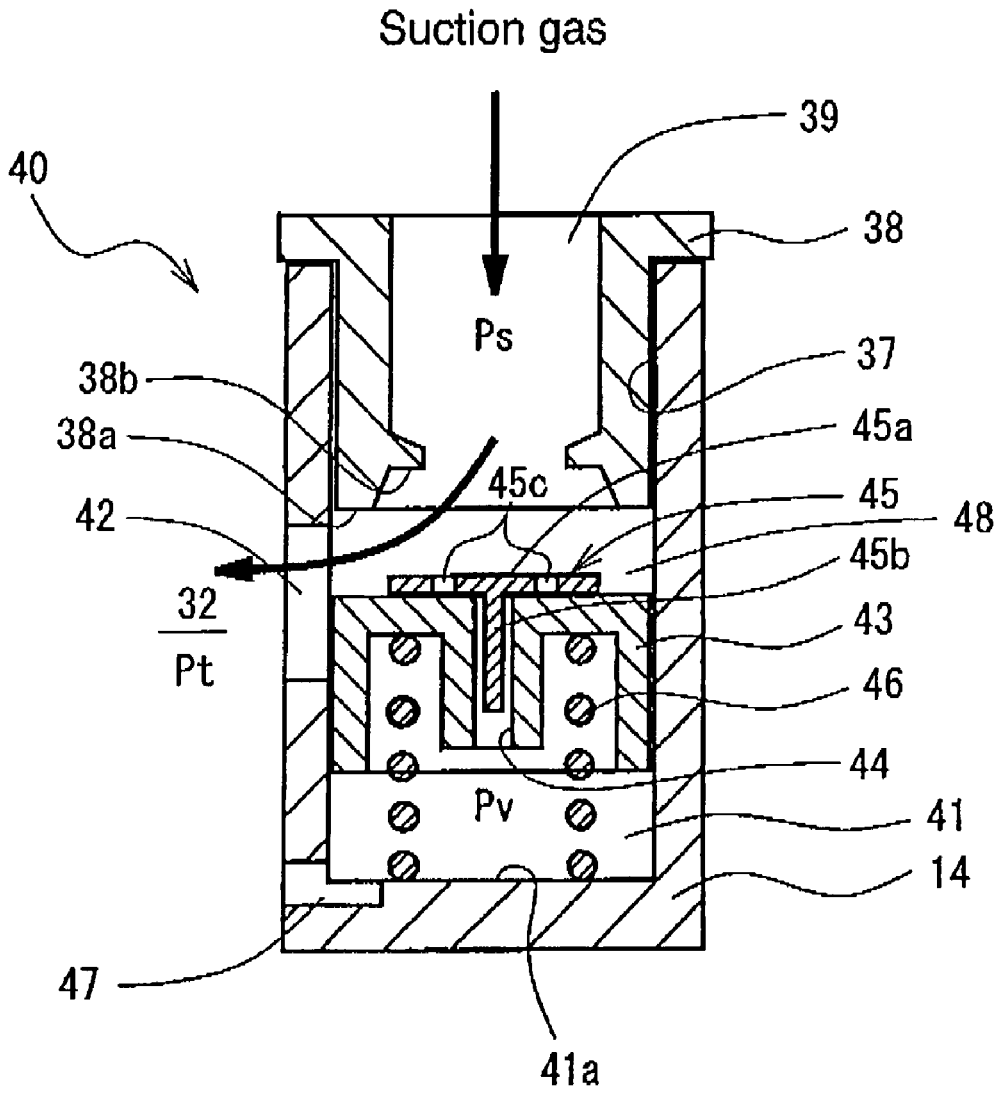
FIG. 2 is an enlarged schematic view showing a major part of a suction throttle valve of the compressor according to the first embodiment.

As shown in FIGS. 1 and 2, a suction throttle valve 40 is arranged in the rear housing 14. The rear housing 14 has a suction passage 37 formed in the shape of a round hole and having an external opening in which a tubular cap 38 is fitted, and a suction port 39 is formed at the inlet of the cap 38. A valve working chamber 48 for the suction throttle valve 40 is formed in the suction passage 37. The valve working chamber 48 and the suction chamber 32 are connected through an inlet port 42 formed through the rear housing 14. A cylindrical valve body 43 is movably disposed in the valve working chamber 48 for adjusting the opening of the suction passage 37.

The valve body 43 has formed therethrough a hole 44 which extends vertically at the center of the valve body 43, and the hole 44 is provided with a float valve 45 that serves as a closing valve. The hole 44 of the valve body 43 serves as a valve hole. The float valve 45 includes a disc-shaped plate 45*a* and a support stem 45*b* provided at the center of the plate 45*a*. The float valve 45 is vertically movably supported by the valve body 43 with the support stem 45*b* of the float valve 45 inserted in the hole 44 from the side of the suction port 39. The support stem 45*b* and the hole 44 have formed therebetween a slight clearance. The plate 45*a* has formed therethrough one or more holes, namely one or more through holes 45*c*. In the present embodiment, the plate 45*a* has plural through holes 45*c*.

The cap 38 provided in the suction passage 37 has formed at the lower end thereof a stop 38*a* for limiting the upward movement of the valve body 43. The cap 38 also has a valve seat 38*b* for limiting the movement of the float valve 45 toward the suction port 39. The valve seat 38*b* is located at a distance from the stop 38*a* toward the suction port 39. A spring 46 that serves as an urging member is provided in the valve working chamber 48 for urging the valve body 43 toward the suction port 39. The valve working chamber 48 has formed therein a valve chamber 41 in which the spring 46 is disposed. The valve chamber 41 and the suction chamber 32 are in communication with each other via a first communication hole 47 formed through the rear housing 14. The valve chamber 41 and the suction port 39 are in communication with each other through the hole 44 of the valve body 43.

As shown in FIG. 2, the valve body 43 of the suction throttle valve 40 is vertically movable in the valve working chamber 48 for controlling the open area of the inlet port 42 or the opening of the suction passage 37. That is, when the valve body 43 is moved to its lowermost position where it comes in contact with the bottom 41*a* of the valve working chamber 48, the open area of the inlet port 42 becomes maximum or the inlet port 42 is fully opened. When the valve body 43 is moved to its uppermost position where it comes in contact with the stop 38*a* at the lower end of the cap 38, on the other hand, the open area of the inlet port 42 becomes minimum or the inlet port 42 is fully closed.

The float valve 45 is movable by the pressure difference between the pressure in the valve chamber 41 and the pressure at the suction port 39. It is so arranged that the float valve 45 closes the hole 44 of the valve body 43 when in contact with the valve body 43 and the float valve 45 opens the hole 44 of the valve body 43 through the through holes 45*c* when in contact with the valve seat 38*b*. The through holes 45*c* of the float valve 45 serves as an intermediate passage, which enables communication between the hole 44 and the suction port 39 when the float valve 45 is in contact with the valve seat 38*b*. Specifically, the through holes 45*c* are opened when the float valve 45 is seated on the valve seat 38*b* and closed when the float valve 45 is in contact with the valve body 43.

The suction port 39 is connected to the suction side of the external refrigerant circuit (not shown), and the refrigerant gas in the external refrigerant circuit is drawn into the suction passage 37 and further into the suction chamber 32 through the suction port 39. In the following description, the suction pressure at the suction port 39, the suction chamber pressure in the suction chamber 32, and the valve chamber pressure in the valve chamber 41 will be called as Ps, Pt, and Pv, respectively. The valve body 43 receives at the upper surface thereof facing the suction port 39 the suction pressure Ps and at the lower surface thereof facing the bottom 41*a* of the valve chamber 41 the valve chamber pressure Pv. The valve body 43 is urged by the spring 46 toward the suction port 39. Therefore, the valve body 43 is moved upward or downward in the valve working chamber 48 according to the resultant force of the resilient force of the spring 46 and the force due to the pressure difference between the suction pressure Ps and the valve chamber pressure Pv.

During normal operation or variable displacement operation of the compressor 10, the float valve 45 is forced against the valve body 43 by a force due to the flow of the refrigerant gas drawn into the suction chamber 32 through the suction port 39 and, therefore, the float valve 45 is moved with the valve body 43. This causes the hole 44 to be closed, thereby shutting off the communication between the valve chamber 41 and the suction port 39, as shown in FIG. 2. In this state, the suction pressure Ps is higher than the suction chamber pressure Pt (or Ps>Pt) and the suction chamber 32 is in communication with the valve chamber 41, so that the suction chamber pressure Pt and the valve chamber pressure Pv is substantially the same (or Pt⁻Pv). Therefore, the suction pressure Ps becomes higher than the valve chamber pressure Pv (or Ps>Pv). This pressure difference between the suction pressure Ps and the valve chamber pressure Pv causes the float valve 45 to be forced against the valve body 43. The pressure difference also causes the valve body 43 and the float valve 45 to be pushed together toward the bottom 41*a* of the valve chamber 41.

Figure 3B:
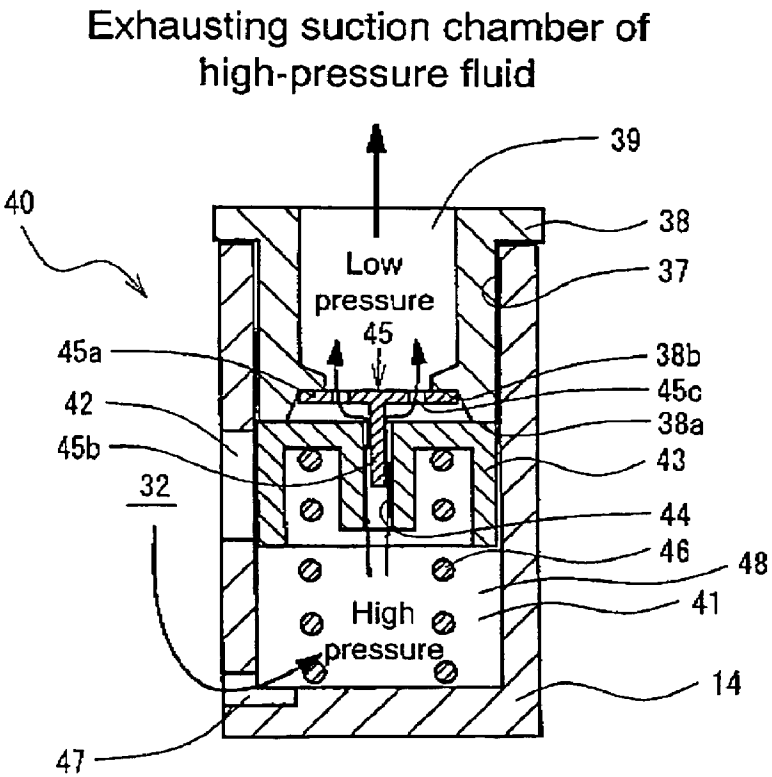
FIG. 3B is a schematic view illustrating the operation of the suction throttle valve when the compressor is turned off during its operation.
Figure 3A:
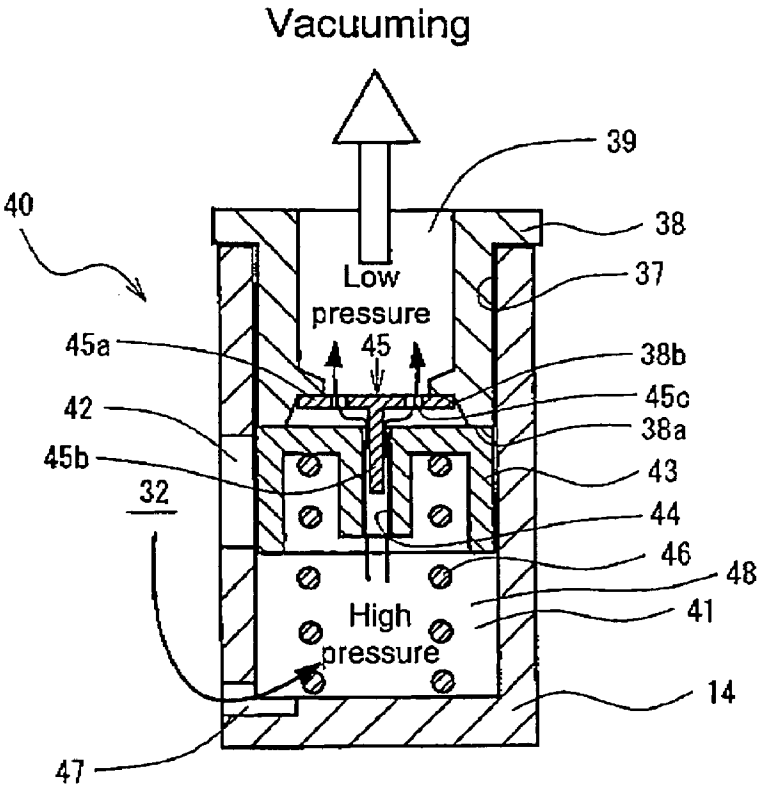
FIG. 3A is a schematic view illustrating the operation of the suction throttle valve during vacuuming of the compressor according to the first embodiment.

Referring to FIGS. 3A and 3B showing the states of the suction throttle valve 40 in vacuuming the compressor and when the compressor is turned off during its operation, respectively, the valve body 43 is raised from the state of FIG. 2 and brought into contact with the stop 38*a* of the cap 38. Although the float valve 45 is spaced away from the valve body 43 and in contact with the valve seat 38*b*, the valve chamber 41 and the suction port 39 are in communication with each other through the hole 44 and the through holes 45*c*. In this state, the pressure at the suction port 39 is lower than that in the valve chamber 41 and that in the suction chamber 32.

The following will describe the operation of the suction throttle valve 40 of the compressor 10 of the first embodiment.

As the drive shaft 17 is rotated, the swash plate 22 is driven to rotate with a wobbling motion and the piston 28 connected to the swash plate 22 reciprocates in the cylinder bore 12*a*, accordingly. As the piston 28 is moved frontward or leftward as seen in the drawing of FIG. 1, refrigerant gas in the suction chamber 32 is drawn into the compression chamber 30 through the suction hole 31*a* and the suction valve 31*c*. Subsequently, as the piston 28 is moved rearward or rightward as seen in the drawing of FIG. 1, refrigerant gas in the compression chamber 30 is compressed to a predetermined pressure and then discharged into the discharge chamber 33 through the discharge hole 31*b* and the discharge valve 31*d*.

As the opening of the displacement control valve 34 is changed thereby to change the crank chamber pressure Pc in the crank chamber 16, the pressure difference between the crank chamber 16 and the compression chamber 30 through the piston 28 is varied and the inclination angle of the swash plate 22 is changed, accordingly. Thus, the stroke of the piston 28 and hence the displacement of the compressor 10 is adjusted. Specifically, as the crank chamber pressure Pc in the crank chamber 16 is lowered, the inclination angle of the swash plate 22 is increased thereby to increase the stroke of the piston 28 and hence the displacement of the compressor 10. As the crank chamber pressure Pc in the crank chamber 16 is raised, on the other hand, the inclination angle of the swash plate 22 is decreased thereby to reduce the stroke of the piston 28 and hence the displacement of the compressor 10.

As shown in FIG. 3A, in vacuuming the refrigerant circuit of the air conditioning system including the compressor 10 before charging the same circuit with refrigerant, the compressor 10 is kept in the stopped state. In this state, the valve body 43 of the suction throttle valve 40 is subjected only to the urging force of the spring 46 and, therefore, the valve body 43 is kept in contact with the stop 38*a* of the cap 38 and the inlet port 42 is closed by the valve body 43. The float valve 45 is moved from the valve body 43 toward the suction port 39 and then in contact with the valve seat 38*b* because the pressure at the suction port 39 is lower than that in the valve chamber 41. In this state, the suction port 39 is in communication with the valve chamber 41 through the clearance between the hole 44 and the support stem 45*b* of the float valve 45 and the through holes 45*c*.

The vacuuming of the compressor 10 is performed by a vacuum pump (not shown) connected, for example, to the suction port 39 of the compressor 10. In the present embodiment, the suction port 39 is in communication with the valve chamber 41 and the valve chamber 41 is in turn in communication with the suction chamber 32 through the first communication hole 47, so that the suction port 39, to which the above vacuum pump is to be connected, is in communication with the suction chamber 32. Therefore, vacuuming the compressor 10 through the suction port 39 can exhaust the compressor 10 of any residual gas and create a vacuum state in the compressor 10.

When the compressor 10 is turned off during its operation, the valve body 43 and the float valve 45 are brought into contact with the stop 38*a* and the valve seat 38*b*, respectively, as shown in FIG. 3B as in the case of the above vacuuming of the compressor 10, so that the suction chamber 32 is in communication with the suction port 39 through the first communication hole 47, the valve chamber 41, the hole 44 and the through holes 45*c* in this order. Therefore, the high-pressure fluid in the suction chamber 32 can be released through the valve chamber 41 and the suction port 39 rapidly. Thus, releasing the high-pressure fluid in the suction chamber 32 rapidly helps to improve reliability of the compressor 10.

Figure 4A:
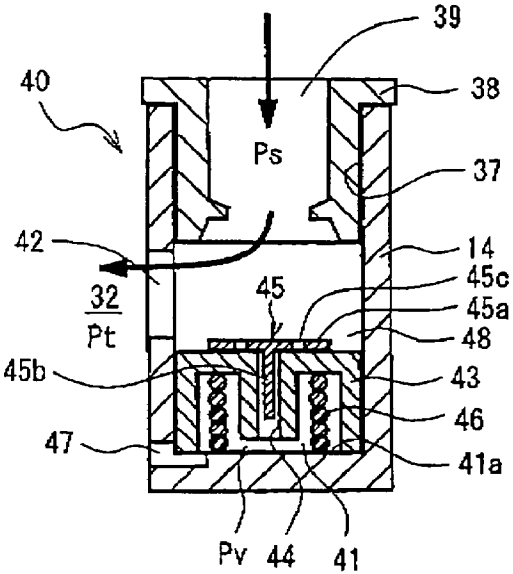
FIG. 4A is a schematic view illustrating the operation of the suction throttle valve during the maximum displacement operation of the compressor according to the first embodiment.

FIG. 4A shows a state of the suction throttle valve 40 when the inclination angle of the swash plate 22 is maximum and, therefore, the compressor 10 is operating at the maximum displacement. When the refrigerant gas at high flow rate flows from the suction port 39 into the suction chamber 32 through the suction passage 37, the valve body 43 is moved in the valve working chamber 48 toward the bottom 41*a* of the valve working chamber 48 against the urging force of the spring 46 thereby to fully open the inlet port 42, as shown in FIG. 4A. In this state, the float valve 45 is kept in contact with the valve body 43 and the compressor 10 can operate at the maximum displacement.

Figure 4B:
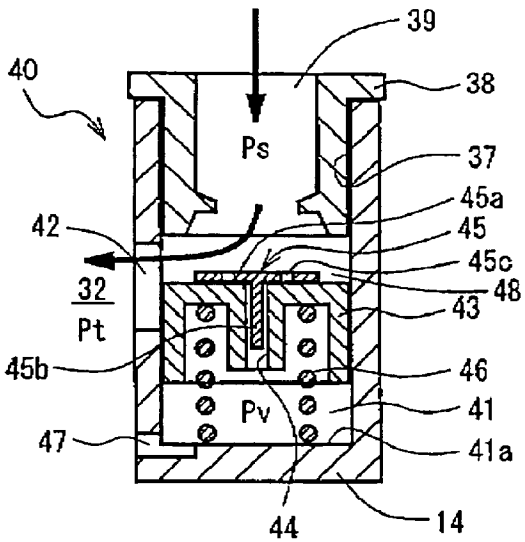
FIG. 4B is a schematic view similar to FIG. 4A, but illustrating the operation of the suction throttle valve during an intermediate displacement operation of the compressor according to the first embodiment.

FIG. 4B shows a state of the suction throttle valve 40 when the compressor 10 is operating at an intermediate displacement with the swash plate 22 inclined between the maximum and minimum positions. The intermediate displacement operation of the compressor 10 corresponds to the normal operation or variable displacement operation of the compressor 10. When the refrigerant gas at an intermediate flow rate flows from the suction port 39 into the suction chamber 32 through the suction passage 37, the valve body 43 is subjected to a force acting on the valve body 43 toward the bottom 41*a* of the valve working chamber 48, but it stays at an intermediate position between the stop 38*a* of the cap 38 and the bottom 41*a* of the valve chamber 41 due to the relation between the above force of the refrigerant gas flow and the urging force of the spring 46, so that the inlet port 42 is partially closed, and the suction passage 37 is restricted, accordingly. This enables the compressor 10 to operate at an intermediate displacement between the maximum and minimum displacements.

During the variable displacement operation of the compressor 10, in particular, when the open area of the inlet port 42 of the suction throttle valve 40 is considerably restricted and the flow rate of the suction refrigerant gas is reduced, the float valve 45 is moved with the valve body 43 in contact therewith. This causes the hole 44 to be closed, thereby shutting off the communication between the valve chamber 41 and the suction port 39, so that refrigerant gas drawn into the suction chamber 32 through the suction port 39 does not leak into the valve chamber 41 through the hole 44. Therefore, the valve body 43 can sufficiently restrict the pressure of suction refrigerant gas during the operation at a low flow rate of suction refrigerant gas, which helps to reduce the vibration and noise that are due to pulsation of suction refrigerant gas.

Figure 4C:
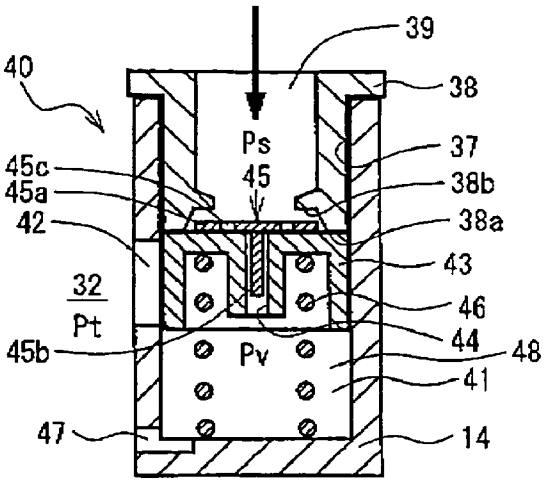
FIG. 4C is a schematic view also similar to FIG. 4A, but illustrating the operation of the suction throttle valve during the minimum displacement operation of the compressor according to the first embodiment.

FIG. 4C shows a state of the suction throttle valve 40 when the compressor 10 is operating at the minimum displacement with the swash plate 22 inclined to its minimum angle position. In this state, only little refrigerant gas is drawn into the suction passage 37 through the suction port 39 and there is little pressure difference between the suction pressure Ps and the suction chamber pressure Pt, accordingly, with the result that the pressure difference between the suction pressure Ps and the valve chamber pressure Pv then acting on the valve body 43 becomes substantially zero. Thus, only the urging force of the spring 46 in effect acts on the valve body 43 toward the suction port 39, so that the valve body 43 is brought into contact with the stop 38*a* of the cap 38 and, therefore, the inlet port 42 is fully closed. The float valve 45 is then in contact with the valve body 43 by its own weight.

The suction throttle valve 40 of the compressor according to the first embodiment has the following advantageous effects.

(1) In vacuuming the refrigerant circuit of the air conditioning system including the compressor 10 before charging the same circuit with refrigerant, the valve body 43 of the suction throttle valve 40 is subjected only to the urging force of the spring 46 and, therefore, the valve body 43 is kept in contact with the stop 38*a* of the cap 38 and the inlet port 42 is closed by the valve body 43. The float valve 45 whose support stem 45*b* is provided in the hole 44 of the valve body 43 is moved off from the valve body 43 toward the suction port 39 until it is brought into contact with the valve seat 38*b* because the pressure at the suction port 39 is then lower than that in the valve chamber 41. In this state, the suction port 39 is in communication with the valve chamber 41 through the clearance between the hole 44 and the support stem 45*b* of the float valve 45 and also the through holes 45*c*, and the valve chamber 41 is in communication with the suction chamber 32 through the first communication hole 47, so that the suction port 39 is in communication with the suction chamber 32. Therefore, vacuuming the compressor 10 through the suction port 39 can exhaust the compressor 10 of any residual gas and create a vacuum state in the compressor 10.

(2) When the compressor 10 is turned off during its operation, the valve body 43 and the float valve 45 are brought into contact with the stop 38*a* and the valve seat 38*b*, respectively, as in the above case of the vacuuming of the compressor 10, so that the suction chamber 32 is in communication with the suction port 39 through the first communication hole 47, the valve chamber 41, the hole 44 and the through holes 45*c*. Therefore, turning off the compressor 10 in operation, the high-pressure fluid in the suction chamber 32 can escape through the valve chamber 41 and the suction port 39 rapidly. This helps to reduce the load acting on the cap 38, which permits the use of less costly structure for fastening the cap 38 to the rear housing 14. In addition, successful exhausting the compressor 10 of an internal fluid helps to reduce the load acting on the cap 38, which improves reliability of the compressor 10.

(3) During the variable displacement operation of the compressor 10, in particular, when the open area of the inlet port 42 of the suction throttle valve 40 is considerably restricted and the flow rate of the suction refrigerant gas is reduced, accordingly, the float valve 45 is in contact with the valve body 43 and moved therewith. This causes the hole 44 for communication between the valve chamber 41 and the suction port 39 to be closed, so that refrigerant gas drawn into the suction chamber 32 through the suction port 39 does not leak into the valve chamber 41 through the hole 44. Therefore, the valve body 43 can perform the function of successfully restricting the pressure of suction refrigerant gas during operation at a low flow rate of suction refrigerant gas, which helps to reduce the vibration and noise that are due to pulsation of suction refrigerant gas.

(4) The float valve 45, which has the support stem 45*b* inserted in the hole 44 of the valve body 43 with a clearance formed between the support stem 45*b* and the hole 44, is moved smoothly with its support stem 45*b* being guided by the hole 44. In addition, the clearance between the support stem 45*b* and the hole 44 also serves as a second communication hole through which the suction port 39 is in communication with the valve chamber 41.

(5) When the float valve 45 is in contact with the valve seat 38*b*, the suction port 39 and the valve chamber 41 are in communication with each other through the hole 44 and the through holes 45*c* formed through the plate 45*a* of the float valve 45. On the other hand, when the float valve 45 is in contact with the valve body 43, the float valve 45 closes the top or one end of the hole 44 of the valve body 43 thereby to shut off the communication between the suction port 39 and the valve chamber 41.

(6) The suction throttle valve 40 is so arranged that only when the compressor 10 is being vacuumed and also when the compressor 10 is turned off during its operation, the float valve 45 is spaced away from the valve body 43 thereby to enable communication between the suction port 39 and the suction chamber 32, which makes it possible to make the clearance between the support stem 45*b* and the hole 44 and the through holes 45*c* with large open areas. This enhances the efficiency of exhausting the compressor 10 of the internal fluid in vacuuming the compressor 10 and of releasing the high-pressure fluid in the suction chamber 32 when the compressor 10 is turned off during its operation.

Figure 5B:
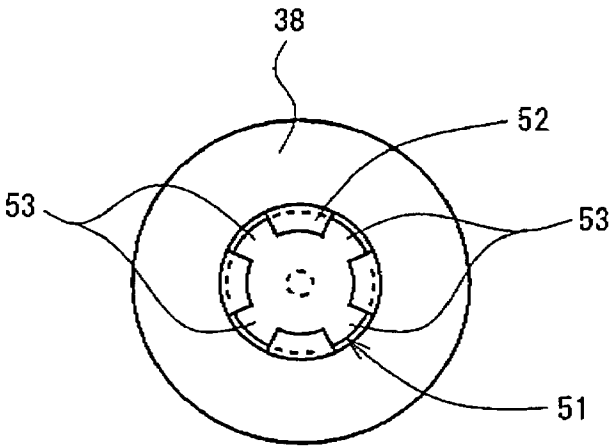
FIG. 5B is a plan view of the suction throttle valve of FIG. 5A.
Figure 5A:
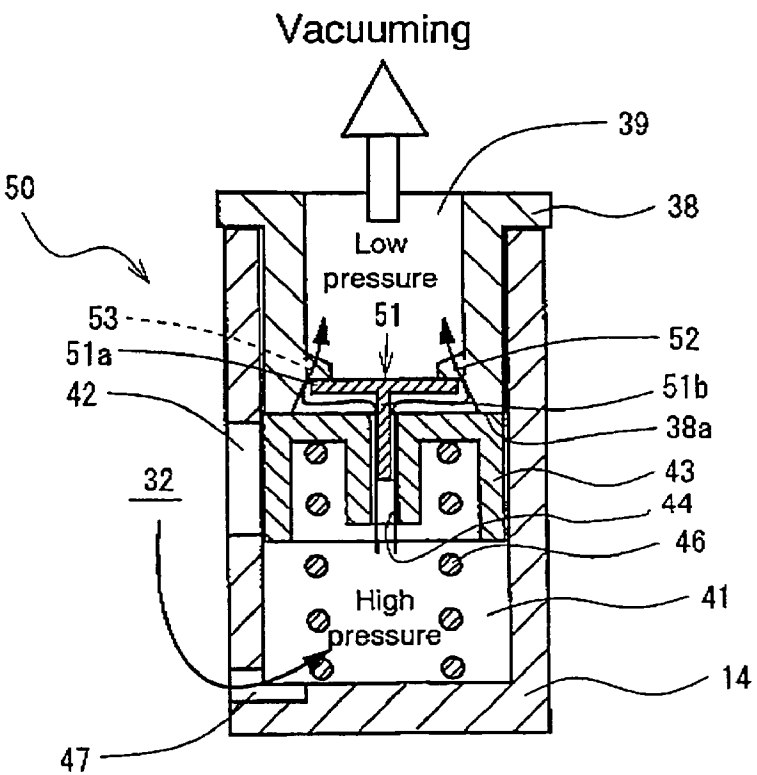
FIG. 5A is an enlarged schematic view of a major part of a suction throttle valve of a compressor according to a second embodiment of the present invention, showing the state of the suction throttle valve when the compressor is being vacuumed.

The following will describe a suction throttle valve 50 of the compressor according to the second embodiment of the present invention with reference to FIGS. 5A and 5B. The compressor of the second embodiment differs from that of the first embodiment in that parts of the float valve 45 and the valve seat 38*b* of the first embodiment are modified and the rest of the structure of the compressor of the second embodiment is substantially the same as that of the first embodiment. For the sake of convenience of explanation, therefore, like or same parts or elements will be referred to by the same reference numerals as those which have been used in the first embodiment, and the description thereof will be omitted.

As shown in FIG. 5A, the suction throttle valve 50 of the second embodiment is so arranged that a plate 51*a* of a float valve 51 dispenses with through holes and, instead, one or more recesses 53 that serve as a communication passage are formed in a valve seat 52 to be in contact with the float valve 51. In the present embodiment, plural recesses 53 are formed in the valve seat 52 and each recess 53 is notch. The recesses 53 enable the communication between the hole 44 and the suction port 39 when the float valve 51 is in contact with the valve seat 52. As shown in FIG. 5B, four recesses 53 are formed in the valve seat 52 along the circumference thereof. When the float valve 51 is in contact with the valve seat 52, the suction port 39 and the valve chamber 41 are in communication with each other through the above recesses 53. When the float valve 51 is in contact with the valve body 43, the communication between the suction port 39 and the valve chamber 41 is shut off because the hole 44 of the valve body 43 is closed at the top by the float valve 51.

The operation of the suction throttle valve 50 of the compressor according to the second embodiment is basically the same as that of the counterpart of the compressor according to the first embodiment because the through holes 45*c* of the first embodiment are replaced by the recesses 53 of the second embodiment. Therefore, the description of operation of the suction throttle valve 50 is omitted.

The suction throttle valve 50 of the compressor according to the second embodiment has the following advantageous effects. The same advantageous effects as those mentioned in the paragraphs (3), (4) and (6) for the first embodiment are accomplished. The second embodiment offers additional advantages as follows.

(7) In vacuuming the refrigerant circuit of the air conditioning system including the compressor 10 before charging the same circuit with refrigerant, the valve body 43 of the suction throttle valve 50 is subjected only to the urging force of the spring 46 and, therefore, the valve body 43 is kept in contact with the stop 38*a* of the cap 38 and the inlet port 42 is closed by the valve body 43. The float valve 51 whose support stem 51*b* is provided in the hole 44 of the valve body 43 is moved off from the valve body 43 toward the suction port 39 until it is brought into contact with the valve seat 52 because the pressure at the suction port 39 is then lower than that in the valve chamber 41. In this state, the suction port 39 is in communication with the valve chamber 41 through the clearance between the hole 44 and the support stem 51*b* of the float valve 51 and also the recesses 53, and the valve chamber 41 is in communication with the suction chamber 32 through the first communication hole 47, so that the suction port 39 is in communication with the suction chamber 32. Therefore, vacuuming the compressor 10 through the suction port 39 can exhaust the compressor 10 of any residual gas and create a vacuum state in the compressor 10.

(8) When the compressor 10 is turned off during its operation, the valve body 43 and the float valve 51 are brought into contact with the stop 38*a* and the valve seat 52, respectively, as in the case of the above vacuuming of the compressor 10, so that the suction chamber 32 is in communication with the suction port 39 through the first communication hole 47, the valve chamber 41, the hole 44 and the recesses 53. Therefore, turning off the compressor 10 in operation, the high-pressure fluid in the suction chamber 32 can escape through the valve chamber 41 and the suction port 39 rapidly. This helps reduce to the load acting on the cap 38, which permits the use of less costly structure for fastening the cap 38 to the rear housing 14. In addition, releasing the high-pressure refrigerant gas in the suction chamber 32 is accomplished thereby to reduce the load acting on the cap 38, so that reliability of the compressor 10 is improved.

(9) When the float valve 51 is in contact with the valve seat 52, the suction port 39 and the valve chamber 41 are in communication with each other through the recesses 53 which are formed in the valve seat 52 to be in contact with the float valve 51. On the other hand, when the float valve 51 is in contact with the valve body 43, the communication between the suction port 39 and the valve chamber 41 is shut off because the top of the hole 44 of the valve body 43 is closed by the float valve 51.

(10) The float valve 51 which dispenses with the through holes helps to reduce the manufacturing cost of the float valve 51.

The present invention is not limited to the above-described embodiments, but may be variously modified within the scope of the invention, as exemplified below.

Figure 6:
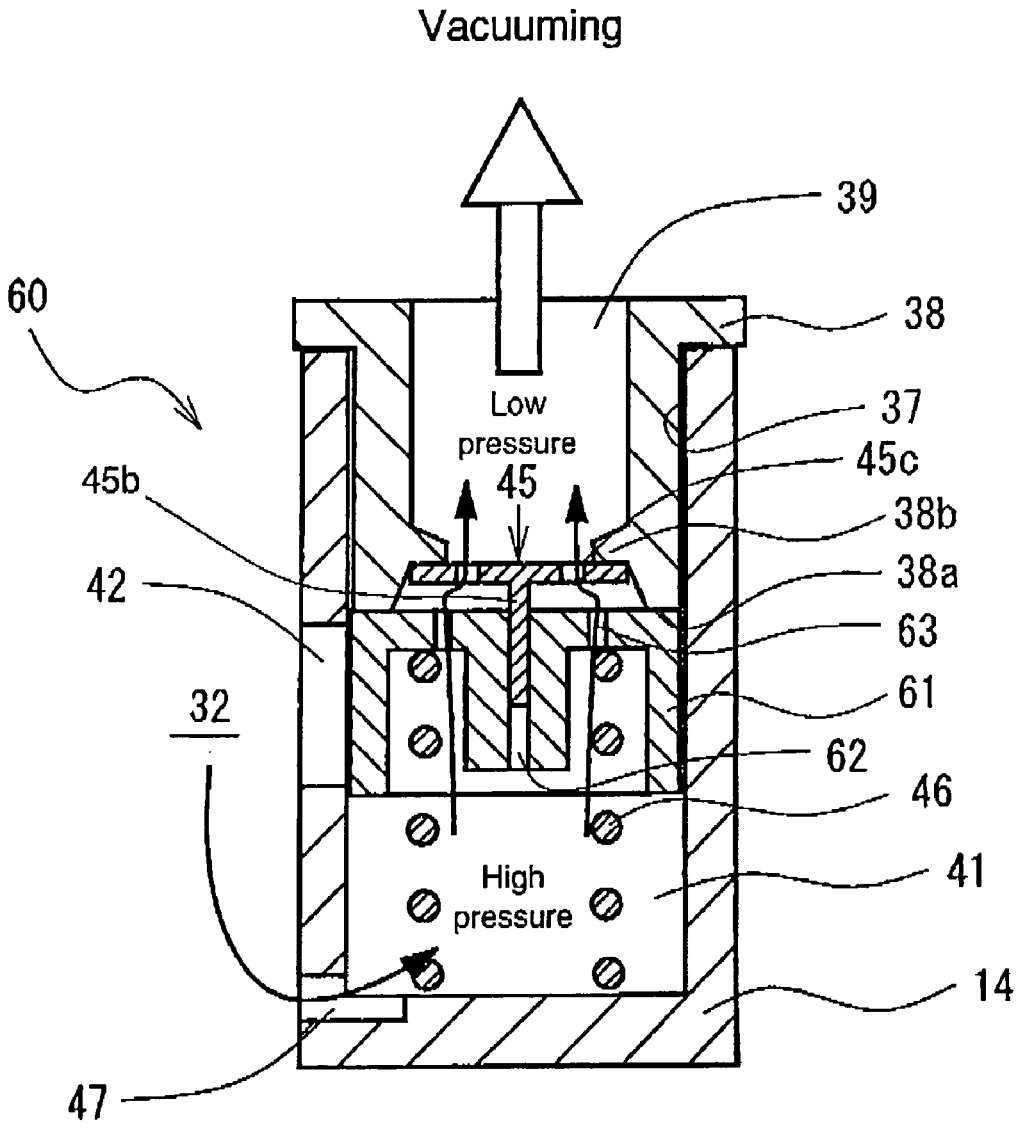
FIG. 6 is an enlarged schematic view showing a major part of a suction throttle valve of a compressor according to another embodiment.

Although the first and second embodiments are described so that the support stem of the float valve is inserted in the hole of the valve body with a clearance between the support stem and the hole and the clearance is used as a second communication hole through which the suction port is in communication with the valve chamber, a valve body 61 of a suction throttle valve 60 may be formed with a plurality of communication holes 63 in addition to the hole 62 for insertion of the support stem 45*b* of the float valve 45, as shown in FIG. 6. When the float valve 45 is in contact with the valve seat 38*b*, the suction port 39 is in communication with the valve chamber 41 through the above communication holes 63. When the float valve 45 is in contact with the valve body 61, the above communication holes 63 are closed by the float valve 45, so that the communication between the suction port 39 and the valve chamber 41 is shut off. The communication holes 63 correspond to a second communication hole of the present invention.

In another modification of FIG. 6, the suction throttle valve 60 may be so arranged that the float valve 45 has plural support stems corresponding to the communication holes 63 of the valve body 61 and that such support stems are inserted in the respective communication holes 63 with clearance formed between the support stems and the communication holes 63.

Although in the first and second embodiments the float valve is used as a closing valve, any other valve may be used as long as it is operable to close the hole of the valve body.

Therefore, the present examples and embodiments are to be considered as illustrative and not restrictive, and the invention is not to be limited to the details given herein but may be modified within the scope of the appended claims.

What is claimed is:

1. A suction throttle valve for a compressor, wherein the compressor has a compressor housing with a suction chamber formed therein the suction throttle valve comprising:

a suction passage formed in the compressor housing;

a suction port formed at an inlet of the suction passage, wherein refrigerant is drawn into the suction passage from the suction port and further into the suction chamber through an inlet port formed in the compressor housing;

a valve body movably disposed in the suction passage for adjusting the size of an opening of the inlet port communicating with the suction passage;

an urging member for urging the valve body toward the suction port;

a valve chamber provided in the suction passage, the urging member being disposed in the valve chamber;

a first communication hole formed through the compressor housing, through which the valve chamber and the suction chamber are in communication with each other;

a valve hole formed through the valve body, through which the valve chamber and the suction port are in communication with each other;

a closing valve for closing the valve hole by a pressure difference between a pressure in the valve chamber and a pressure at the suction port; and a valve seat provided in the suction passage for limiting movement of the closing valve toward the suction port, wherein the valve hole is closed when the closing valve is in contact with the valve body, wherein the valve hole is open when the closing valve is in contact with the valve seat, and wherein an intermediate passage is formed in the closing valve or the valve seat, which enables communication between the valve hole and the suction port when the closing valve is in contact with the valve seat.

2. The suction throttle valve according to claim 1, wherein the closing valve has a support stem inserted in the valve hole with a clearance formed between the outer circumference of the support stem and the inner circumference of the valve hole.

3. The suction throttle valve according to claim 1, wherein the intermediate passage is a through-hole formed through the closing valve, wherein the through-hole is opened when the closing valve is seated on the valve seat and closed when the closing valve is in contact with the valve body.

4. The suction throttle valve according to claim 3, wherein the through-hole is one of a plurality of through-holes formed through the closing valve to define the intermediate passage.

5. The suction throttle valve according to claim 1, wherein the intermediate passage is a recess formed in the valve seat, which enables communication between the suction port and the valve hole when the closing valve is in contact with the valve seat.

6. The suction throttle valve according to claim 5, wherein the recess is one of a plurality of recesses formed in the valve seat that defines the intermediate passage.

7. The suction throttle valve according to claim 1, wherein the closing valve is a float valve, which includes a disc-shaped plate and a support stem provided at the center of the plate.

8. The suction throttle valve according to claim 1, wherein at least one end of the valve hole defines a second communication hole within the valve body, wherein when the closing valve is in contact with the valve seat, the suction port is in communication with the valve chamber through the intermediate passage and the second communication hole, and wherein when the closing valve is in contact with the valve body, the closing valve closes the one end of the valve hole defining the second communication hole to thereby shut off communication between the suction port and the valve chamber.

9. The suction throttle valve according to claim 1, wherein the valve body has a cylindrical shape.

10. The suction throttle valve according to claim 1, wherein the urging member is a spring.

11. The suction throttle valve according to claim 1, wherein a tubular cap is fitted in the suction passage, wherein the suction port is formed at an inlet of the cap within the inlet of the suction passage.

* * * * *